US005719589A

United States Patent [19]

Norman et al.

[11] Patent Number: 5,719,589

[45] Date of Patent: Feb. 17, 1998

[54] ORGANIC LIGHT EMITTING DIODE ARRAY DRIVE APPARATUS

[75] Inventors: Michael P. Norman, Chandler; George W. Rhyne, Scottsdale; Warren L. Williamson, Mesa, all of Ariz.

[73] Assignee: Motorola, Inc., Schaumburg, Ill.

[21] Appl. No.: 584,827

[22] Filed: Jan. 11, 1996

[51] Int. Cl.[6] ..... G09G 3/32

[52] U.S. Cl. ..... 345/82; 345/209

[58] Field of Search ..... 345/44, 46, 82, 345/83, 206, 208, 209

[56] References Cited

U.S. PATENT DOCUMENTS

| | | | |
|---|---|---|---|
| 3,696,393 | 10/1972 | McDonald | 345/82 |
| 3,819,974 | 6/1974 | Stevenson et al. | 313/499 |
| 4,441,106 | 4/1984 | Jackson | 345/82 |
| 4,769,292 | 9/1988 | Tang et al. | 313/504 |
| 5,051,738 | 9/1991 | Tanielian et al. | 345/82 |
| 5,424,560 | 6/1995 | Norman et al. | 257/40 |
| 5,593,788 | 1/1997 | Shi et al. | 313/504 |

*Primary Examiner*—Jeffery Brier
*Attorney, Agent, or Firm*—Eugene A. Parsons

[57] ABSTRACT

Drive apparatus for an array of organic LEDs including first switches connectable between a current source or a rest potential, second switches connectable to a power source, an array of LEDs with each LED having a first contact connected to one of the first switches and a second contact connected to one of the second switches, and control apparatus connecting selected switches of the first switches to the current source while retaining all remaining switches of the first switches connected to the rest potential, and periodically connecting selected switches of the second switches, one at a time, to the power source to generate a desired image on the array.

20 Claims, 2 Drawing Sheets

ORGANIC LIGHT EMITTING DIODE ARRAY DRIVE APPARATUS

FIELD OF THE INVENTION

The present invention pertains to drive apparatus for light emitting diode arrays and more specifically to drive apparatus for organic light emitting diode arrays.

BACKGROUND OF THE INVENTION

Light emitting diode (LED) arrays are becoming more popular as an image source in both direct view and virtual image displays. One reason for this is the fact that LEDs are capable of generating relatively high amounts of light (high luminance), which means that displays incorporating LED arrays can be used in a greater variety of ambient conditions. For example, reflective LCDs can only be used in high ambient light conditions because they derive their light from the ambient light, i.e. the ambient light is reflected by the LCDs. Some transflective LCDs are designed to operate in a transmissive mode and incorporate a backlighting arrangement for use when ambient light is insufficient. In addition, transflective displays have a certain visual aspect and some users prefer a bright emissive display. However, these types of displays are generally too large for practical use in very small devices.

Also, organic LED arrays are emerging as a potentially viable design choice for use in small products, especially small portable electronic devices, such as pagers, cellular and portable telephones, two-way radios, data banks, etc. Organic LED arrays are capable of generating sufficient light for use in displays under a variety of ambient light conditions (from little or no ambient light to bright ambient light). Further, organic LEDs can be fabricated relatively cheaply and in a variety of sizes from very small (less than a tenth millimeter in diameter) to relatively large (greater than an inch) so that organic LED arrays can be fabricated in a variety of sizes. Also, LEDs have the added advantage that their emissive operation provides a very wide viewing angle.

Generally, organic LEDs include a first electrically conductive layer (or first contact), an electron transporting and emission layer, a hole transporting layer and a second electrically conductive layer (or second contact). The light can be transmitted either way but must exit through one of the conductive layers. There are many ways to modify one of the conductive layers for the emission of light therethrough but it has been found generally that the most efficient LED includes one conductive layer which is transparent to the light being emitted. Also, one of the most widely used conductive, transparent materials is indium-tin-oxide (ITO), which is generally deposited in a layer on a transparent substrate such as a glass plate.

The major problem with organic LEDs utilizing a conductive, transparent layer is the high resistivity of the material. ITO, for example, has a resistivity of approximately 50 ohms/square (75 to several hundred ohms/square). Further exacerbating this problem is the fact that organic LEDs are current driven devices (i.e. emit due to current flowing through them), as opposed to voltage driven devices, such as LCDs. Thus, the high resistivity contact of the organic LED becomes virtually prohibitive when attempting to place organic LEDs in large arrays.

An additional problem prevalent in organic LEDs is a reduction in efficiency with usage. The theory which has developed is that particles within the organic layers tend to migrate with current during use of the LED. This migration reduces the efficiency of the organic LED so that either less light is emitted or more current must be supplied to produce a constant amount of light and ultimately results in failure of the organic LEDs. To achieve the higher current, the application of a larger voltage is required across the device, which means that more power is consumed. Some attempts have been made to solve this problem, the major one being to apply a reverse bias to the diode during none-use periods. This solution creates its own problems because it requires another power source to provide the reverse bias. The additional power source adds substantially to the size, weight, and cost of the display.

Accordingly, it would be beneficial to provide an organic LED array and driving apparatus which overcomes these problems.

It is a purpose of the present invention to provide a new and improved organic LED array and driving apparatus.

It is another purpose of the present invention to provide a new and improved organic LED array and driving apparatus in which column charges are rapidly removed to obtain a high quality image.

It is another purpose of the present invention to provide a new and improved organic LED array and driving apparatus which is relatively inexpensive to manufacture and operate.

It is still another purpose of the present invention to provide a new and improved organic LED array and driving apparatus which produces relatively constant light.

It is a further purpose of the present invention to provide a new and improved organic LED array and driving apparatus with a relatively long life.

It is a still further purpose of the present invention to provide a new and improved organic LED array and driving apparatus which does not require additional power sources and which produces a brightness in excess of 600 fL, or in excess of 200 fL after filtering.

SUMMARY OF THE INVENTION

The above problems and others are at least partially solved and the above purposes and others are realized in drive apparatus for an array of LEDs including a first plurality of switches each connectable between one of a constant current source and a rest potential, a second plurality of switches each connectable to a power source, an array of LEDs connected into rows and columns, each LED having a first contact connected to one of the first plurality of switches and a second contact connected to one of the second plurality of switches, and control apparatus connected to the first and second pluralities of switches for connecting selected switches of the first plurality of switches to the constant current source while retaining all remaining switches of the first plurality of switches connected to the rest potential, and connecting selected switches of the second plurality of switches to the power source.

The above problems and others are at least partially solved and the above purposes and others are further realized in a method of driving an array of LEDs including the steps of providing an array of LEDs with each LED having first and second contacts, with the first contacts connected into a plurality of columns and the second contacts connected into a plurality of rows, connecting selected columns of first LED contacts to individual current sources and a first row of second LED contacts to a power source so as to drive current into the selected columns of first LED contacts and out the first row of second LED contacts, and driving unselected columns of first LED contacts to a rest potential below a level where individual LEDs of the plurality of LEDs will turn ON and remaining rows of the plurality of rows to a row rest potential which may, or may not be the same as the column rest potential, and periodically connecting each row of the remaining plurality of rows of LEDs to an active pulldown, such as the power source, one at a time, while connecting selected columns of LEDs to individual current sources during each period to produce a desired image on the array, and simultaneously retaining unselected columns of first LED contacts at the column rest potential and the remaining rows of the plurality of rows connected to the row rest potential. The OFF state potentials for the rows and columns are then design parameters for optimal treatment of the organic material during the OFF state, as well as controlling the charge state of rows and columns.

By connecting the first contact of the LEDs to a current source and the second contact to a power source, current is driven into the LED by way of the first contact. Placing the rest potential on unselected columns of light emitting diodes and connecting unselected rows of light emitting diodes to a row rest potential causes current to be driven out of LEDs in the OFF mode and also drives migrant carriers back toward their original position so as to increase the efficiency and life of the LEDs.

BRIEF DESCRIPTION OF THE DRAWINGS

Referring to the drawings.

DESCRIPTION OF THE PREFERRED EMBODIMENTS

Figure 1:
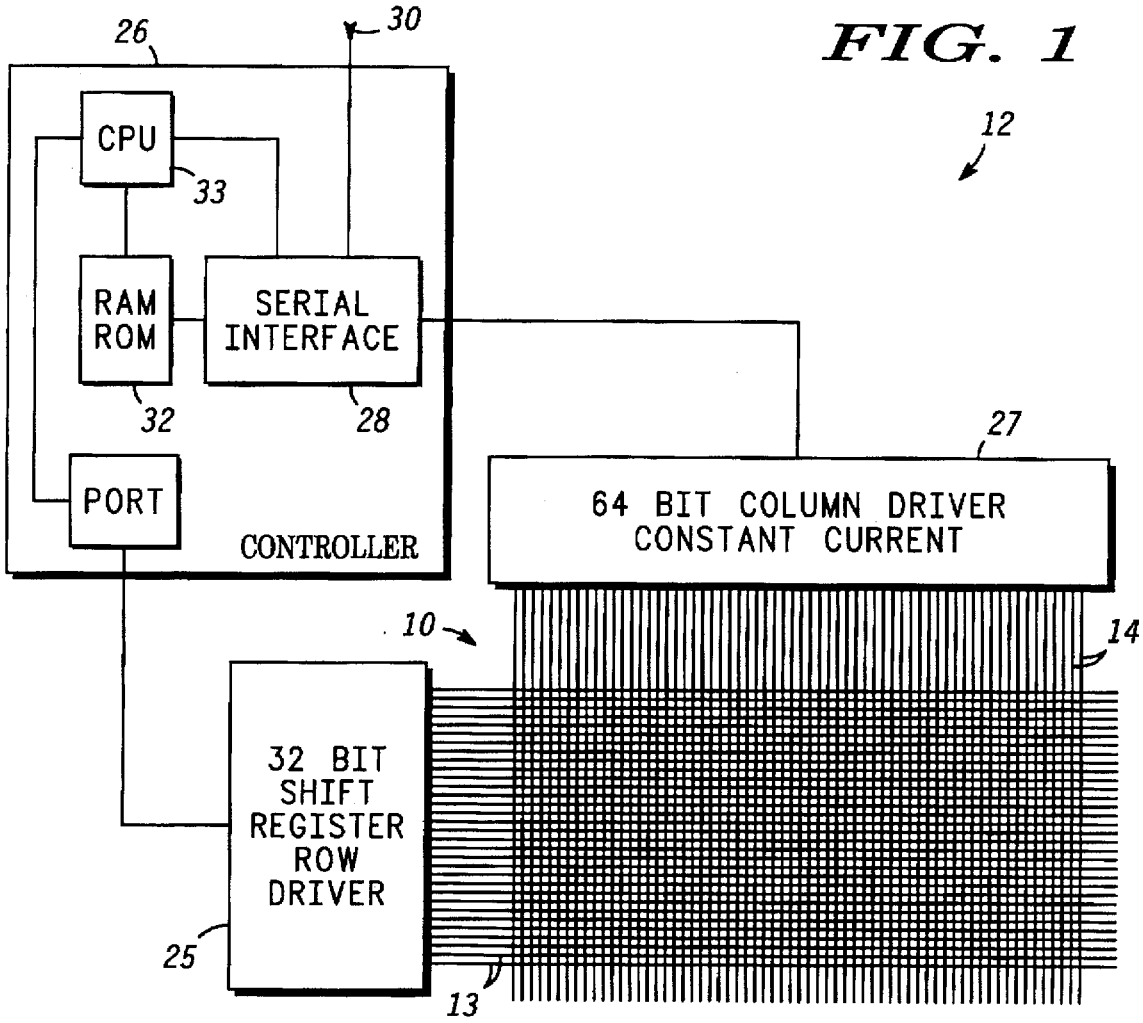
FIG. 1 is a simplified block diagram of a light emitting diode array with drive apparatus connected thereto in accordance with the present invention.

Referring specifically to FIG. 1, a simplified block diagram of a light emitting diode array 10 is illustrated with drive apparatus 12 connected thereto in accordance with the present invention. In this specific embodiment array 10 includes a plurality of organic light emitting diodes (LEDs) connected into thirty two rows and sixty four columns. Thirty two row terminals 13 are illustrated at the right side of array 10 in FIG. 1 and sixty four column terminals 14 are illustrated at the top. Generally, when fabricating large arrays of LEDs it is common practice to bring every-other terminal to the opposite side of the array so that the pitch (distance between adjacent terminals) is increased. However, the terminals are all illustrated on the same side in this instance to simplify the drawings. It will of course be understood that any number of rows and columns of LEDs can be provided and that the present example is only utilized for illustrative purposes.

Figure 2:
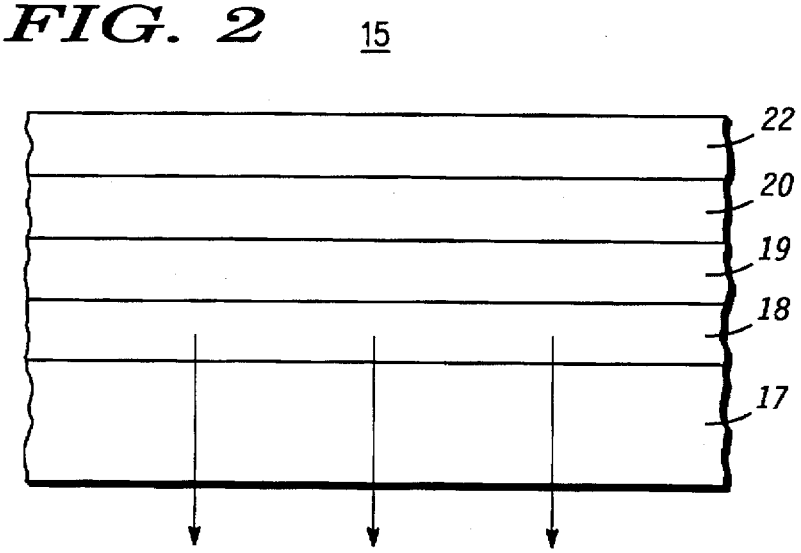
FIG. 2 is a simplified cross-sectional view of a typical organic light emitting diode.

A typical organic LED 15 is illustrated in a simplified cross-sectional view in FIG. 2. Generally, either the anode (positive electrical contacts) or the cathode (negative electrical contacts) of an LED must be optically transparent to allow the emission of light therethrough. In this embodiment LED 15 includes a substrate 17 which is formed of a transparent material, such as glass, quartz, or a hard plastic or the like. Even some semiconductor materials are transparent to light and may be utilized as substrate 17, in which instance some of the electronics may be integrated directly onto the substrate. A positive conductive layer 18 is patterned onto the upper surface of substrate 17 in any of the many well known procedures, e.g. using photoresist or the like. Conductive layer 18 is patterned into a plurality of parallel spaced apart columns terminating in terminals 14 (FIG. 1). In this specific example, conductive layer 18 is provided as a layer of ITO.

A hole transport layer 19 is positioned on the upper surface of layer 18. Generally, for convenience in manufacturing array 10, layer 19 is deposited as a blanket deposition over the upper surface of layer 18 and any exposed portions of substrate 17, since only the portion of layer 19 which overlies layer 18 will be activated. An electron transport and light emission layer 20 is positioned over the upper surface of layer 19. It should be understood that organic diodes are presently being fabricated with one to several organic layers and organic LED 15 is only illustrated for purposes of this explanation. Also, to reduce the potential required in embodiments not incorporating an electron transport layer, a cathode is generally formed of a layer 22 of low work function metal/conductors or combination of metals/conductors, at least one of which typically has a low work function. In this embodiment the cathode (layer 22) is formed of low work function material, such as the commonly used lithium or magnesium, or the cathode may be a conductive metal incorporating cesium, calcium or the like.

A list of some possible examples of materials for the organic layer or layers (e.g. 19 and 20) of the above described organic LEDs follows. As a single layer of organic, some examples are: poly(p-phenylenevinylene) (PPV); poly(p-phenylene) (PPP); and poly[2-methoxy, 5-(2'-ethylhexoxy) 1,4-phenylenevinylene] (MEH-PPV). As an electron transporting electroluminescent layer between a hole transporting layer or one of the single layer organics listed above and a low work function metal cathode, an example is: 8-hydroxquinoline aluminum (ALQ). As an electron transporting material, an example is: 2-(4-tert-butylphenyl)-5-(p-biphenylyl)-1,3,4-oxadiazole (butyl-PBD). As a hole transport material, some examples are: 4,4'-bis[N-phenyl-N-(3-methylphenyl)amino]biphenyl (TPD); and 1,1-bis(4-di-p-tolyaminophenyl)cyclohexane. As an example of a fluorescent that may be used as a single layer or as a dopant to an organic charge transporting layer is coumarin 540, and a wide variety of fluorescent dyes. Examples of low work function metals include: Mg:In, Ca, and Mg:Ag.

While array 10 (FIG. 1) is described as having a single organic LED for each pixel of an image, it should be understood that additional LEDs can be connected in parallel for additional brightness or redundancy. Also, an example of the incorporation of multiple LEDs in a single pixel to produce multiple colors, or full color, is disclosed in U.S. Pat. No. 5,424,560, entitled "Integrated Multicolor Organic LED Array", issued Jun. 13, 1995 and assigned to the same assignee.

Each LED in array 10 includes one or more layers of polymers or low molecular weight organic compounds, generally as described above. Hereinafter, for simplification of this disclosure, the term organic/polymer will be shortened to "organic" but it should be understood that this term is intend to encompass all polymers or low molecular weight organic compounds. The organic materials that form layers 19 and 20 are chosen for their combination of electrical, luminescent and color properties, and various combinations of hole injecting, hole transporting, electron injecting, electron transporting, and luminescent or emitting materials can be used.

In general, in organic electroluminescent or LED devices it should be understood that organic layers 19 and 20 do not conduct electrons well and the electron resistivities (e.g., approximately $10e^{-7}$) are much higher than the hole resistivities (e.g., approximately $10e^{-3}$) in the same material. Also, electron transport layer 20 conducts electrons relatively well but does not conduct holes well and can thus be thought of as a hole blocking layer. Further, it should be understood that generally light, or photons, are generated when electrons and holes combine. Thus, because holes are transported readily through organic layers 19 and 20 and because electrons are transported readily through electron transport layer 20, substantially all recombination of holes and electrons occurs at or near the junction of layers 19 and 20, but usually in layer 20. As the materials of layers 19 and 20 age (electrical current passes therethrough), there is a tendency for various particles and defects to migrate within the material, causing the light emission to spread into less efficient material. It has been found that this phenomenon can be overcome or reversed by periodically reversing the potential across the LED. The manner of accomplishing this feature in the present invention will be described presently.

Referring again to FIG. 1, drive apparatus 12 includes a circuit for periodically cycling through the 32 rows of array 10. In the simplified block diagram of FIG. 1 this circuit is illustrated as a 32 bit shift register (and row driver) 25. Shift register 25 is connected to a controller 26, which supplies clock pulses and any other driving information which may be required. A 64 bit column driver 27 is connected to column terminals 14 and supplies image data thereto. Generally, column driver 27 includes an individual driver for each column terminal 14 and a buffer or the like for storing a complete row of image information. Column driver 27 is connected to controller 26 for receiving each new row of image information therefrom.

Controller 26 includes a serial interface 28 which supplies image data to column driver 27 and which optionally receives video or image data from an external data input 30. Serial interface 28 is also connected to a RAM/ROM memory 32 and to a central processing unit (CPU) 33, or the like. CPU 33 controls both column drivers 27 and shift register 25 and utilizes memory 32 to generate images on array 10. It will of course be understood by those skilled in the art that a wide variety of circuits can be utilized to control array 10 and controller 26, along with shift register 25 and column drivers 27, are simply one embodiment utilized for purposes of explanation herein.

Figure 3:
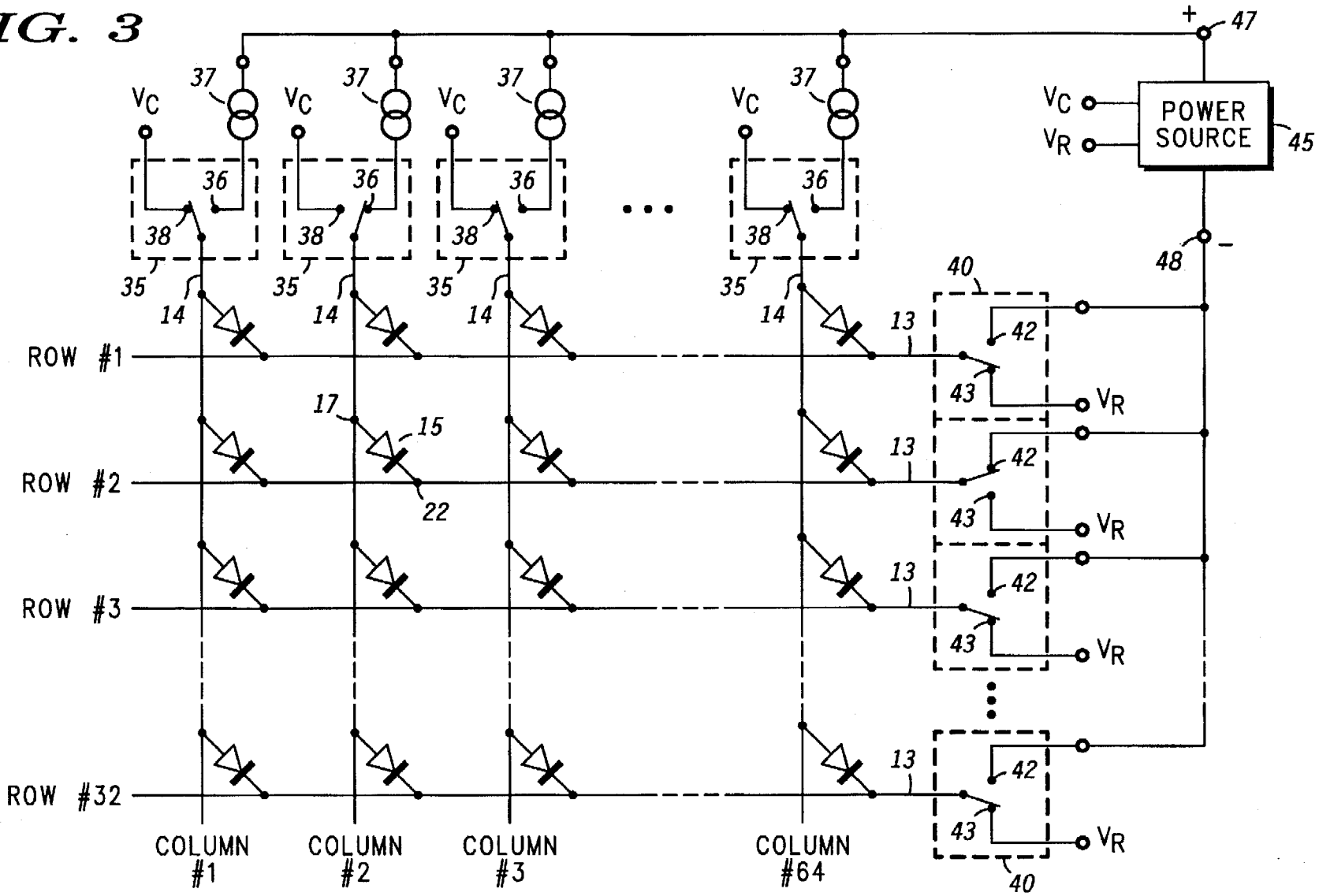
FIG. 3 is a schematic representation of portions of the structure illustrated in FIG. 1.

Referring now to FIG. 3, a schematic representation of portions of the structure of FIG. 1 are illustrated. Array 10 is illustrated in more detail, with a diode (e.g. diode 15) connected between each crossing of each column conductor (terminals 14) and each row conductor (terminals 13). Conductive layer 18 is patterned on substrate 17 to form the column conductors and terminals 14. Layer 22 is patterned to form the row conductors and terminals 13. As explained above, because conductive layer 18 must be transparent to the light generated by the diodes, it generally has a relatively high resistance. Further, since the rows are cycled ON one row at a time, the maximum number of diodes that will be conducting in a column at a time is one. Thus, each of the column conductors will carry a maximum current equal to the current conducted by one LED 15 (e.g. approximately 1–2 mA).

Assuming, for example, that ITO is used to form the column conductors, the resistivity ranges from about 7.5 ohms/square to 400 ohms/square. While the resistivity can be lowered by increasing the thickness of the column conductors, there are problems with uniformity of ITO which can lead to device defects as the conductor is thickened. Thus, a typical column conductor formed of ITO may be approximately 50 ohms/square. The resistance along a column conductor between adjacent rows would then be about 80 ohms. Over 30 rows, at 80 ohms/row, this results in a total of over 2.4 kohms of resistance between the first and the last LED in the column. Since one LED draws a current of approximately 1–2 mA, this gives a 2–5 volt difference for driving the same current into the last LED versus the first LED in the column. If the LEDs are voltage driven this variation in voltage over the length of a column means that additional compensation circuitry is required if the brightness of the LEDs is to be uniform across the entire array 10. If the LEDs are current driven this variation in voltage is not a problem.

Any number from zero to all of the diodes connected into each row may be conducting simultaneously (depending upon the image) so that each of the row conductors (layer 22), may be required to carry the current of all of the diodes (e.g. 64×approximately 1–2 mA). Thus, the row conductors are formed of a metal having as low a resistance as practical. However, due to the long, thin rows in array 10, the resistance for a row conductor may still be as much as 5 ohms. If, for example, enough LEDs are conducting in a row to draw 100 mA of current, this 5 ohms of resistance produces a voltage drop of 0.5 volts from one end of the row conductor to the other. Thus, it is clear that the resistance of each row must be dropped as low as practical by adding thickness to the row conductors and/or adding conductors, such as gold, etc. if these materials are practical. Where possible for the application, a good reason to not add an additional conductor is that additional process steps must be incorporated into the manufacturing process, which adds additional expense.

Each column terminal 14 has a switch 35 attached thereto which is depicted schematically as a single-throw double-pole switch, for convenience. It will of course be understood that a wide variety of different switches can be used and generally, because of the speed and size required, each switch 35 will be any of the various semiconductor switches which are well known in the art. Each of the switches 35 has a first terminal, or input 36, connected to a current source 37 and a second terminal or input 38 connected to a column rest potential, designated $V_R$, so that each switch 35 is connectable between one of current source 37 and column rest potential $V_R$. Each switch 35 is controlled by CPU 33 and/or data from serial interface 28, depending upon the type of image being generated and the addressing scheme.

Each row terminal 13 has a switch 40 attached thereto which is depicted schematically as a single-throw double-pole switch, for convenience. As explained above, it should be understood that a wide variety of different switches can be used and generally, because of the speed and size required, each switch 40 will be any of the various semiconductor switches which are well known in the art. Each switch 40 has a first terminal, or input 42, connected to a power source 45 and a second terminal or input 43 connected to a row rest potential $V_R$ which may or may not be the same as the column rest potential, and may be an open terminal (or unconnected), so that each switch 40 is connectable between one of power source 45 and an open circuit or row rest potential. In this specific example, each switch 40 is a stage of shift register 25 which is controlled by CPU 33. However, many other types of switches capable of switching a power source into and out-of the circuit might be used as switches 40, as will be understood by those skilled in the art.

Power source 45 may be any source capable of supplying the required amount of power as, for example, a battery, solar cells, various combinations of the two, etc. Also, current sources 37 may be any of the many current sources well known to those skilled in the art. Because the column conductors are the positive terminals (layer 18) of LEDs 15 in array 10 and the row conductors are the negative terminals (layer 22), a negative terminal 46 of power source 45 is connected to first terminal 42 of each switch 40 and a positive terminal 47 of power source 45 is connected to each current source 37 to complete a circuit through array 10. Also, in this specific embodiment, column rest potential $V_C$ is taken from power source 45 although, as will be explained presently, column rest potential $V_C$ (combined with a row rest potential) can be any potential below a level where individual LEDs of array 10 will turn ON. By utilizing power source 45 as $V_C$, or some lesser potential tapped off of negative terminal 48, additional power sources are not required and the final product is considerably smaller, lighter, and less expensive.

Here it should be understood that the schematic representation of FIG. 3 actually represents a family of drivers for use with an organic LED array. For example, while the embodiment illustrated drives current into the columns utilizing a current source for each column, current can be driven into the columns by controlling either the voltage on or the current into the columns, with the latter being preferred. Also, while an open at the row switches maybe utilized as a row rest potential, virtually any convenient row rest potential can be used. Generally, the row rest potential should be higher than the column rest potential so that each of the diodes spends some time in a reverse biased condition. Also, the circuit generating the column rest potential should be a relatively low impedance and capable of carrying current, so the column charges stored in the column circuits of the array can be quickly dissipated or discharged.

The operation of light emitting diode array 10 and drive apparatus 12, as illustrated in FIG. 3, will now be described for purposes of an example. As explained previously, shift register 25 cycles through each of the thirty two rows, one at a time, by moving switch 40 of a selected row into contact with power source 45 (first input 42) while maintaining switch 40 of each of the remaining thirty one rows in contact with second input 43 and the row rest potential. As each specific row is selected, column driver 27 determines which of the sixty four LEDs in that row are to be turned ON and connects switch 35 of each corresponding column to the current source 37 associated therewith. In FIG. 3, for example, only LED 15 at the junction of row #2 and column #2 is connected to current source 37 and power source 45. In each of the thirty two rows, from zero to sixty four LEDs will be turned ON to generate a desired image on array 10. Column terminals 14 connected to LEDs which are not turned ON remain connected to column rest potential $V_C$.

Thus, current is driven into the positive terminal of each selected LED 15 in each row by the associated current source 37. Further, because each LED 15 is driven by its associated current source 37, each of the thirty two LEDs in a column are driven by the same amount of current regardless of their position along the column and the specific voltage required by the LED at the intersection of that row and column, which can vary considerably. One of the problems with array 10 is the high resistance of the column conductors which, along with various capacitances inherent in the system, produces a relatively high RC time constant that results in a significant amount of charge being built up and stored during normal operation. This charge build-up can result in shadows being generated as an image changes, due to a charge remaining on previously actuated LEDs.

The present invention overcomes this problem by connecting unselected LEDs in a selected row, and unselected LEDs in unselected rows, to column rest potential $V_C$ and the row rest potential $V_R$. The combination of column rest potential $V_C$ and the row rest potential $V_R$ reverse biases the LEDs in unselected rows and columns, at the desired level according to the specific implementation, and any charge build-up within the unselected LEDs is mitigated, or is driven out of the LEDs. Unselected rows are connected to the row rest potential $V_R$ by associated switches 40, so that unselected rows are driven to the desired level. Since at least some of switches 35 are usually connected to column rest potential $V_C$, the potential of the floating unselected rows moves toward column rest potential $V_C$. In a specific example, $V_C$ is −33 volts and the unselected rows (rows #1, #3–#32 in FIG. 3) are driven or drift to a potential approximately 8 volts below that of the ON LED. This produces a reverse bias on the unselected row and column conductors relative to the potential at terminal 46 of power source 45.

The net result of connecting unselected column terminals 14 to column rest potential $V_C$ and unselected row terminals 13 to a row rest potential $V_R$, is to produce a reverse bias on LEDs that are turned OFF, which reverse bias drives charge build-up out of the LEDs and produces a potential thereacross that refreshes, or causes migration of particles back toward the original position. Thus, all of the LEDs in array 10 are refreshed at irregular intervals (depending upon the images being produced) and degradation of the LEDs normally due to migration of particles is stopped, reversed, and/or slowed down. Because of this feature, the life of the LEDs in array 10 is substantially increased, depending upon the specific materials, the efficiency remains relatively constant and luminance remains relatively constant. Also, the reverse bias and the feature of driving charge build-up out of the LEDs is achieved with no additional power sources or other expensive and space consuming components.

Accordingly, a new and improved organic LED array and driving apparatus is disclosed which is relatively inexpensive to manufacture and operate. Further, the new and improved organic LED array and driving apparatus produces relatively constant light and has a relatively long life. The life of the array is increased by the novel reverse bias applied to individual devices during normal operation. Also, the new and improved organic LED array and driving apparatus does not require additional power sources and produces a brightness in excess of 600 fL. Because of this brightness, the organic LED array and driving apparatus can be in displays for virtually any application, including low and high ambient light conditions. Further, the size, versatility and cost of manufacturing the organic LED array and driving apparatus makes it very competitive with other displays, such as LCDs and the like.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. Drive apparatus for an array of light emitting diodes comprising:

a first plurality of switches each connectable between one of a current source and a rest potential;

a second plurality of switches each connectable to a power source;

an array including a plurality of light emitting diodes connected into rows of light emitting diodes and columns of light emitting diodes, each light emitting diode having a first contact connected to one of the first plurality of switches and a second contact connected to one of the second plurality of switches; and control apparatus connected to the first and second pluralities of switches for connecting selected switches of the first plurality of switches to the current source while retaining all remaining switches of the first plurality of switches connected to the rest potential, and connecting selected switches of the second plurality of switches to the power source.

2. Drive apparatus for an array of light emitting diodes as claimed in claim 1 wherein the control apparatus includes circuitry for periodically connecting each switch of the second plurality of switches, one at a time, to the power source while retaining all remaining switches of the second plurality of switches connected to a row rest potential.

3. Drive apparatus for an array of light emitting diodes as claimed in claim 2 wherein the circuitry for periodically connecting each switch of the second plurality of switches includes a shift register.

4. Drive apparatus for an array of light emitting diodes as claimed in claim 1 wherein the first and second pluralities of switches include semiconductor switches.

5. Drive apparatus for an array of light emitting diodes as claimed in claim 1 wherein the plurality of light emitting diodes include organic light emitting diodes.

6. Drive apparatus for an array of light emitting diodes as claimed in claim 5 wherein the organic light emitting diodes each include one electrical contact formed of a transparent conductive material.

7. Drive apparatus for an array of light emitting diodes as claimed in claim 6 wherein the plurality of organic light emitting diodes are positioned on a transparent substrate with the transparent conductive material being formed into a plurality of columns on the surface of the substrate.

8. Drive apparatus for an array of light emitting diodes as claimed in claim 7 wherein the transparent conductive material includes indium-tin-oxide.

9. Drive apparatus for an array of light emitting diodes as claimed in claim 7 wherein the transparent conductive material formed into a plurality of columns on the surface of the substrate forms the first contact for each of the organic light emitting diodes.

10. Drive apparatus for an array of light emitting diodes as claimed in claim 1 wherein the first plurality of switches each include a first input having an individual current source coupled thereto.

11. Drive apparatus for an array of light emitting diodes as claimed in claim 10 wherein the first plurality of switches each include a second input having a rest potential coupled thereto, which rest potential is below a level where individual light emitting diodes of the plurality of light emitting diodes will turn ON.

12. Drive apparatus for an array of light emitting diodes as claimed in claim 10 wherein the power source connectable to the second plurality of switches includes a battery having a positive terminal coupled to the individual current sources and a negative terminal connectable to the second plurality of switches.

13. Drive apparatus for an array of organic light emitting diodes comprising:

a first plurality of switches each connectable between one of a first input having an individual current source coupled thereto and a second input having a column rest potential coupled thereto, the column rest potential being below a level where individual light emitting diodes of the plurality of light emitting diodes will turn ON;

a second plurality of switches each connectable between one of a first input having a power source coupled thereto and a second input connected to a row rest potential;

an array including a plurality of organic light emitting diodes connected into rows of organic light emitting diodes and columns of organic light emitting diodes, each organic light emitting diode having a first contact formed of transparent conductive material connected to one of the first plurality of switches and a second contact connected to one of the second plurality of switches; and control apparatus connected to the first and second pluralities of switches for connecting selected switches of the first plurality of switches to the current source while retaining all remaining switches of the first plurality of switches connected to the column rest potential, and periodically connecting each switch of the second plurality of switches, one at a time, to the power source while retaining all remaining switches of the second plurality of switches connected to the row rest potential.

14. Drive apparatus for an array of organic light emitting diodes as claimed in claim 13 wherein the plurality of organic light emitting diodes are positioned on a transparent substrate with the transparent conductive material being formed into a plurality of columns on the surface of the substrate.

15. Drive apparatus for an array of organic light emitting diodes as claimed in claim 14 wherein the transparent conductive material includes indium-tin-oxide.

16. Drive apparatus for an array of organic light emitting diodes as claimed in claim 15 wherein the transparent conductive material is formed into a plurality of columns on the surface of the substrate and forms the first contact for each of the organic light emitting diodes.

17. Drive apparatus for an array of organic light emitting diodes as claimed in claim 14 wherein each of the organic light emitting diodes includes a layer of hole transporting material positioned adjacent the transparent conductive material and a layer of electron transporting material positioned adjacent the layer of hole transporting material.

18. Drive apparatus for an array of organic light emitting diodes as claimed in claim 13 wherein the power source coupled to first input of the second plurality of switches includes a battery having a positive terminal coupled to the individual current sources and a negative terminal coupled to the first input of the second plurality of switches.

19. A method of driving an array of light emitting diodes comprising the steps of:

providing an array of light emitting diodes including a plurality of light emitting diodes with each light emitting diode of the plurality of light emitting diodes having a first contact and a second contact, the plurality of light emitting diodes, each with the first contact and the second contact, defining a plurality of the first contacts and a plurality of the second contacts with the plurality of the first contacts connected into a plurality of columns of first light emitting diode contacts and the plurality of the second contacts connected into a plurality of rows of second light emitting contacts;

connecting selected columns of first light emitting diode contacts to individual current sources and a first row of second light emitting diode contacts to a power source so as to drive current into the selected columns of first light emitting diode contacts and out the first row of second light emitting diode contacts, and connecting unselected columns of first light emitting diode contacts to a column rest potential below a level where individual light emitting diodes of the plurality of light emitting diodes will turn ON and remaining rows of the plurality of rows to a row rest potential; and periodically connecting each row of the remaining plurality of rows of light emitting diodes to the power source, one at a time, while connecting selected columns of light emitting diodes to individual current sources during each period to produce a desired image on the array, and simultaneously retaining unselected columns of first light emitting diode contacts at the column rest potential and the remaining rows of the plurality of rows connected to the row rest potential.

20. A method of driving an array of light emitting diodes as claimed in claim 19 wherein the step of providing the array of light emitting diodes includes providing an array of organic light emitting diodes positioned on a transparent substrate with a layer of transparent conductive material forming a first contact for each of the plurality of organic light emitting diodes and with the layer of transparent conductive material being formed into a plurality of columns on the surface of the substrate.

* * * * *